United States Patent [19]

Reimer

[11] Patent Number: 4,621,876

[45] Date of Patent: Nov. 11, 1986

[54] EQUIPMENT DRAWER SUPPORT

[75] Inventor: William A. Reimer, Wheaton, Ill.

[73] Assignee: GTE Communication Systems Corp., Northlake, Ill.

[21] Appl. No.: 775,899

[22] Filed: Sep. 13, 1985

[51] Int. Cl.[4] ..... A47B 91/00

[52] U.S. Cl. ..... 312/250; 16/100; 312/320

[58] Field of Search ..... 312/320, 250, 311, 294, 312/330 R, 352; 16/96 R, 100, 102, 101; 211/151; 280/79.2; 49/396, 404, 323; 238/10 R

[56] References Cited

U.S. PATENT DOCUMENTS

| | | | |
|---|---|---|---|
| 1,772,314 | 8/1930 | Hormes | 16/100 |
| 2,078,811 | 4/1937 | Rouse | 16/100 |
| 2,185,763 | 1/1940 | De Lisle | 312/320 X |
| 2,553,459 | 5/1951 | Klein | 16/100 |
| 4,208,755 | 6/1980 | Shepherd | 49/404 X |
| 4,540,119 | 9/1985 | Neuhierl | 238/10 R |

*Primary Examiner*—James T. McCall
*Attorney, Agent, or Firm*—Robert J. Black

[57] ABSTRACT

A support for a vertically oriented equipment drawer including a plurality of guide rollers and a band roller attached to a lower edge thereof, the guide roller riding in a lower guide track positioned on a supporting equipment floor and the band roller rolling on a band of flexible material layed out in the path of the roller as the equipment drawer is withdrawn from an equipment frame. A tensile force is applied to the band to take up slack and optionally to exert a force on the band roller to permit the equipment drawer to automatically retract back into the equipment frame. A latch is included to engage the band when the equipment drawer is in a withdrawn position to prevent automatic retraction of the equipment drawer. Flat guide rollers engaging an upper guide track are attached to an upper edge of the equipment drawer to prevent lateral movement thereof.

12 Claims, 3 Drawing Figures

EQUIPMENT DRAWER SUPPORT

BACKGROUND OF THE INVENTION (1) Field of the Invention

The present invention relates to equipment mounting techniques and more particularly to equipment drawers and equipment drawer supports employing rollers.

(2) Background Art

Supports for equipment are very well known to those skilled in the art. In this regard, packaging of equipment in vertical drawers which slide in and out for maintenance and service on slides of the ball bearing and multiple slide type are known. Additionally, it is known to the employ rollers which engage a supporting floor to provide support and rolling motion to a drawer of vertical equipment. Commercial slides are known to provide excellent sliding characteristics but have been found to be expensive and frequently difficult to properly align during assembly. Roller techniques, on the other hand, while generally inexpensive and readily aligned, have been found to be sensitive to materials used for construction of the supporting floor surface. In this regard foreign objects, cracks between floor tiles or the use of carpets have been found to make the use of rollers burdensome due to the impairment of rolling motion experienced with these types of floor surfaces. Additionally, the roller wheels have been found to mar and leave unsightly marks on floor surfaces.

Accordingly, it is an object of the present invention to provide a new and useful roller support which is inexpensive and easily aligned and also which is not effected in its operation by the condition of the supporting floor surface.

SUMMARY OF THE INVENTION

The present invention overcomes the above problems by providing a band roller attached to an equipment drawer which engages a band of flexible material positioned between the roller and a supporting surface. The roller bears against the band to support the drawer in rolling movement and the band is adapted to provide a rolling surface for the band roller and to prevent said roller from directly contacting said support surface while protecting said support surface from damage.

The present invention may also include an equipment frame mounted to the supporting floor surface, including a drawer slot adapted to receive the equipment drawer and including a lower guide track attached to the support surface, and the equipment drawer may include a second roller attached to the lower edge of the drawer near a rear edge thereof, the second roller engaging the guide track and supporting, in cooperation with band roller, the equipment drawer. The band may be attached to the lower guide track via a first end and attached to the equipment drawer via a spring connected to a second end to anchor the band, positioning the band relative to the lower guide track and provide means to take up slack in the band when the drawer is retracted into the equipment frame, a retainer may be included in the equipment drawer to engage the band when the drawer is in a withdrawn position to lock the band and prevent the drawer from retracting. Finally, an upper guide track may be provided within the equipment frame and an upper roller may be provided on an upper edge of the equipment drawer to guide the drawer during rolling movement.

DESCRIPTION OF THE PREFERRED EMBODIMENT

Figure 1:
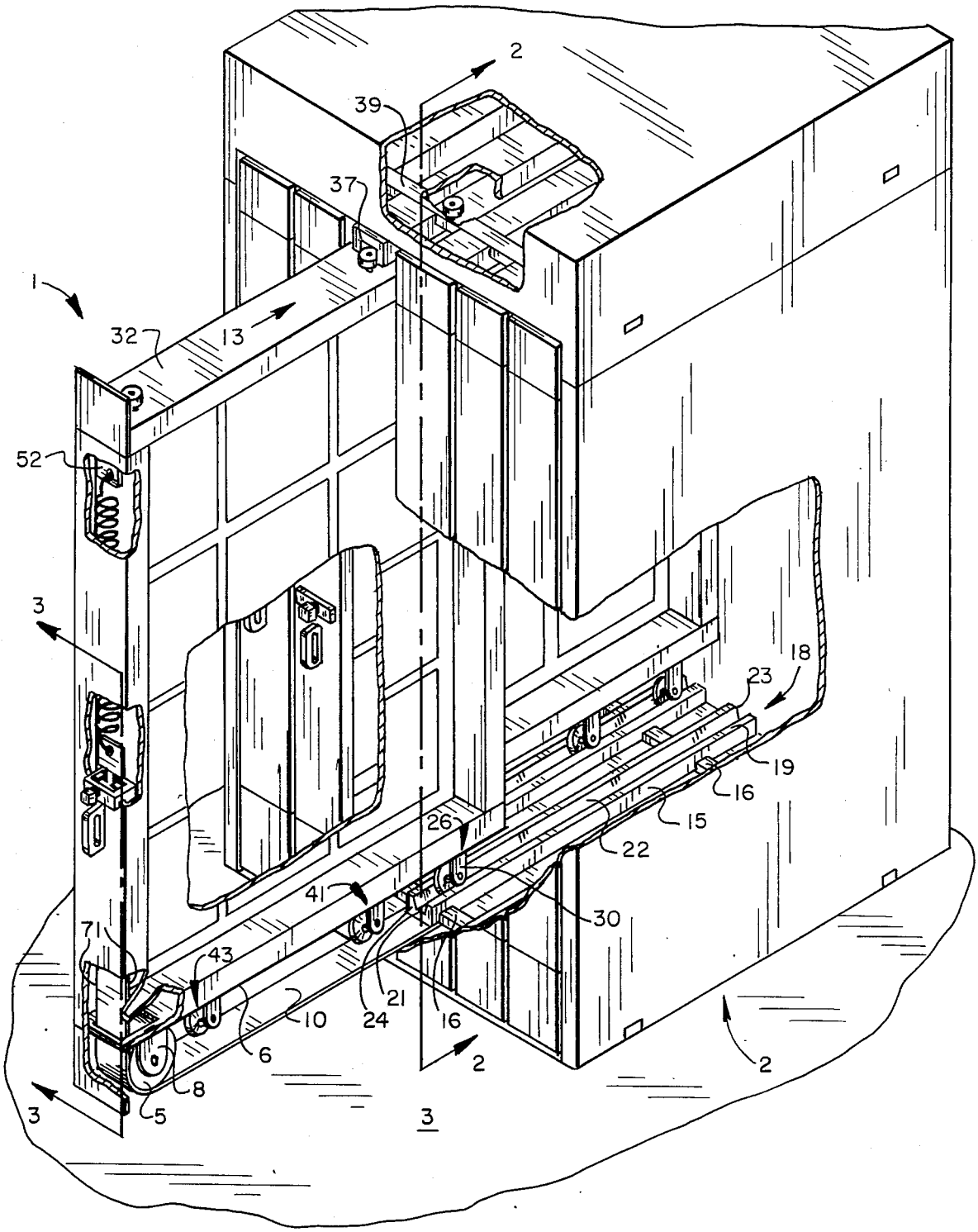
FIG. 1 is perspective view of the equipment support of the present invention.

Referring now to FIG. 1 there is shown a support for an equipment drawer 1 adapted to be positioned in rolling relation within an equipment frame 2 mounted on a supporting surface which may be an equipment room floor. The support includes a band roller 5 attached to a lower surface 6 of the equipment drawer 1 by means of arms 8. A band of flexible material 10 is positioned between the band roller 5 and the support surface 3 to provide an efficient rolling surface for the band roller 5. The equipment frame 2 includes a plurality of drawer slots 13, each adapted to receive an equipment drawer 1 therein. A lower guide track is provided within each of the drawer slots 13 mounted to the equipment frame 2 by means of lateral positioning members 16. The lower guide track 15 includes a v-shaped guide groove 18 formed in an upper surface 19 thereof. The guide groove 18 is of v-shaped cross-section including a flat bottom 21 and a pair of sloping sides 22 extending between an inner end 23 and an outer end 24 of the guide track. The sloping sides 22 of the groove 18 diverge as they extend between the flat bottom 21 and the upper guide surface 19.

A first lower guide roller 26 is provided including a tread 28 of slender circumferential band construction with a pair of sloping guide walls 29. The first lower guide roller 26 is attached to the lower edge 6 of the equipment drawer 1 by means of pair of arms 30. The first lower guide roller 26, tread 28 and guide walls 29 engage the lower guide track flat bottom 21 and sloping sides 22 respectively in connection with the band roller 5 to support and guide the equipment drawer as hereinafter described.

Figure 2:
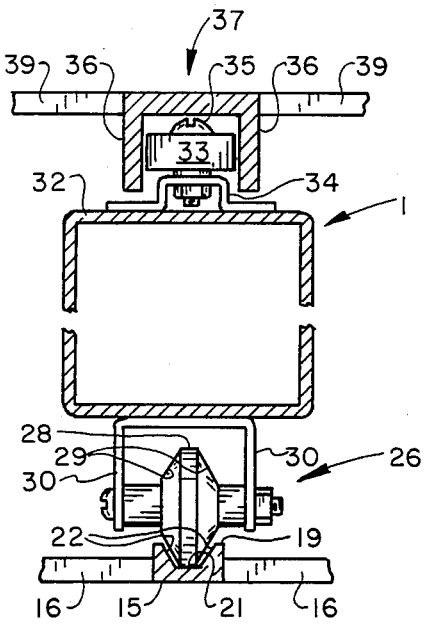
FIG. 2 is a partial cross-sectional view of the equipment drawer taken along the line 2—2 in FIG. 1.

Referring now to FIG. 2, the equipment drawer 1 additionally includes an upper edge 32 to which is attached at least one upper guide roller 33 of cylindrical construction rotating about a vertical axis. The upper guide roller 33 is attached to the upper edge 32 of the equipment drawer by means of a bracket 34 and a fastener 35. The upper guide roller 33 which is adapted to engage and ride within a pair of vertical walls 36 of an upper guide track 37 of inverted U-shaped construction. The upper guide track 37 is attached to the equipment frame 2 by means of lateral positioning members 39. The upper guide roller 33 and upper guide track 37 cooperate to guide the upper end equipment drawer 1 in rolling relation to the equipment frame 2.

Referring again to FIG. 1, a second lower guide roller 41 may be provided attached between the band roller 5 and the lower guide roller 26, shaped and attached similar to the first lower guide roller 26 but positioned nearer the first lower guide roller 26 than to the band roller 5.

Additionally, a third roller guide roller 43 may be provided of construction similar to the first lower guide roller 26 but positioned on the lower edge 6 of the equipment drawer 1 between the band roller 5 and the second guide roller 41 and nearer the band roller 5 than to the second guide roller 41.

Figure 3:
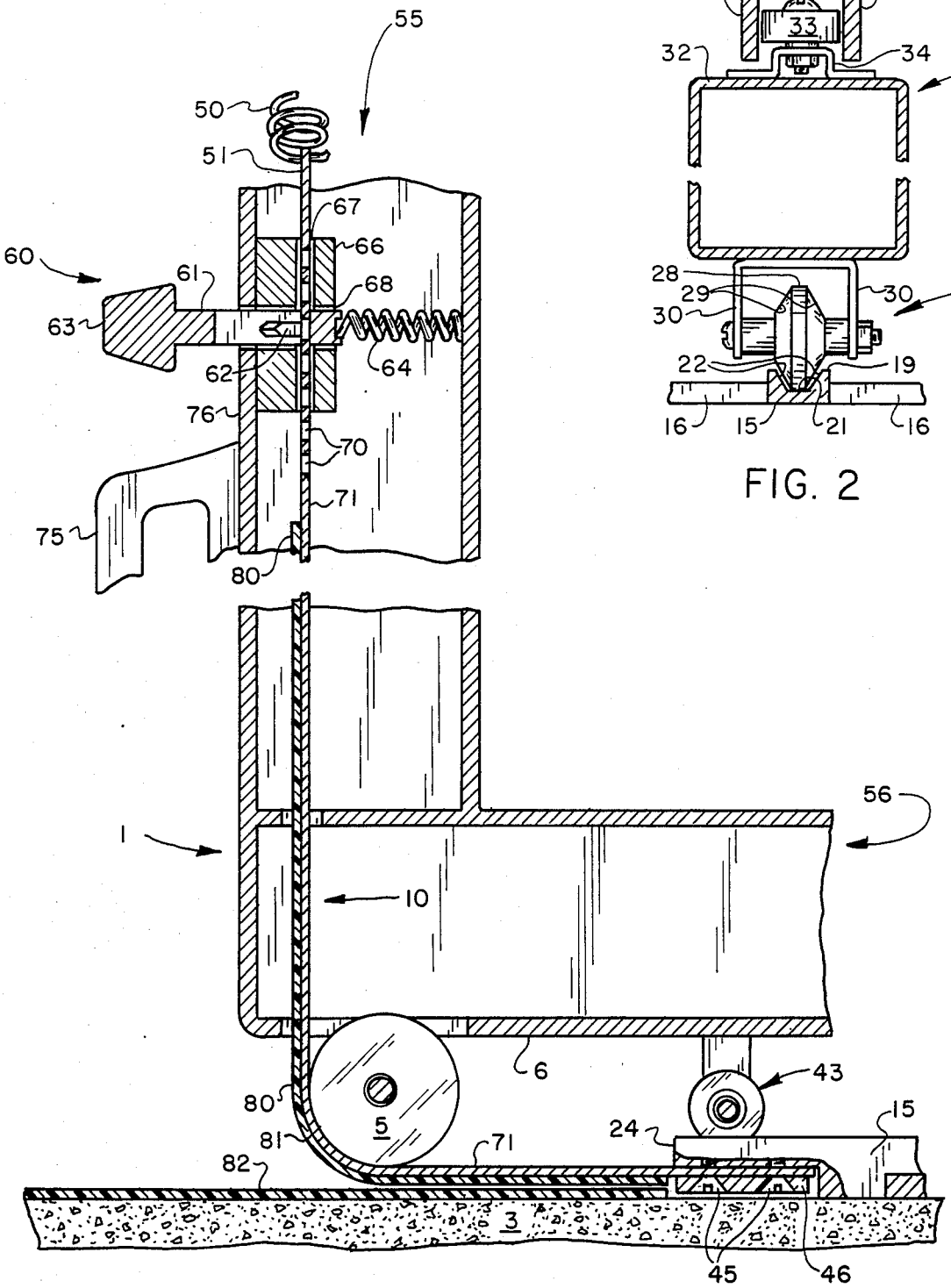
FIG. 3 is a partial cross-sectional view of the equipment drawn of the present invention taken along the line 3—3 in FIG. 1.

Referring now the FIG. 3, the band 10 may be attached to the lower guide track 15 by any means commonly known in the art. For example, several fasteners 45 may be employed to clamp the band 10 between the lower guide track 15 and a clamping plate 46 to rigidly affix the band to the lower guide track and prevent movement therebetween.

A spring 50 is included attached between a second end 51 of the band 10 and an anchor 52 (see FIG. 1) of the equipment drawer 1. The anchor 52 may be attached to a front vertical column 55 of the equipment drawer 1 by any means known to those skilled in the art such as welding or the use of mechanical fasteners. The spring 50 is merely illustrative of a means to apply tensile force to the second end 51 of the band 10. It will be appreciated by those skilled in the art that any comparable means may be equally effectively used in the subject invention. The tensile force applied by the spring 50 to the band 10 will function to take up slack in the band 10 as the equipment drawer is rolled into a retracted position within the equipment frame and will permit the band to be rolled out on the support surface 3 when the equipment drawer 1 is rolled out of the equipment frame 2. It will be noted that while the embodiment of FIG. 3 depicts the band being retracted into the front vertical column 55 of the equipment drawer 1, the band 10 may equally well be positioned horizontally within a lower column 56 of the equipment drawer 1, with the spring 50 attached to an anchor similar to the anchor 52 (shown in FIG. 1).

A band lock 60 is provided in the vertical column 55 of the equipment drawer 1 to engage and lock the band 10 in position relative to the drawer 1 when the drawer is in a withdrawn position. The band lock 60 includes a latch 61 including a pair of band engaging blades 62 and an operating pushbutton 63. The engaging blades 62 are biased into engagement with the band by means of a latch biasing spring 64. A guide block 66 including a vertically oriented band channel 67 and a horizontally oriented latch channel 68 is provided within the vertical column 55 to guide and position the latch 61 and the band 10 in relation to each other. The band 10 includes a plurality of catch notches 70 formed in opposite sides 71 of the band (see FIG. 1). The catch notches 71 are engaged by the band engaging blades 62 of the latch 61. A handle 75 is provided attached to a front surface 76 of the vertical column 55 of the equipment drawer 1 for the purpose of withdrawing and restoring the equipment drawer within the equipment frame 2. The handle 75 is positioned to permit single handed operation of the equipment drawer while depressing the latch operating pushbutton 63.

In operation and referring to FIG. 1, the equipment drawer of the present invention may be operated from a restored or retracted position within the equipment frame 2 to a withdrawn or extended position extending out the front surface of the equipment frame 2 by grasping the handle 75 while simultaneously depressing the pushbutton 63 of the latch 61 and applying a force to the handle in a direction away from the equipment frame 2. In its retracted or normal position, the equipment drawer 1 will be supported by the first, second, and third lower guide rollers 26, 41, and 43 respectively. The band roller 5 and the band 10 will be suspended above the support surface 3. Lateral movement of the upper edge 32 of the equipment drawer 1 is prevented by the upper guide rollers 33 acting against the upper guide track 37.

As the equipment drawer moves out of its retracted position under the force applied to the handle 75, the band roller 5 will lay out the rolling band above support surface 3 against the tensile force exerted by the spring 50 and at the same time the third guide roller 43 will travel along the guide track 15 to the front edge thereof at which point it will disengage the guide track thereby permitting the equipment drawer 1 to rock forward and permit the band 10 to contact the support surface 3 thereby transferring support of the front of the equipment frame 1 from the third guide roller 43 to the band roller 5 while preventing the band roller 5 from contacting the equipment floor 3. Prevention of band roller to equipment floor contact is beneficial to prevent irregularities and surface conditions of the equipment floor from affecting the rolling characteristics of the band roller 5 and to prevent marring and damage to the equipment floor. As the equipment drawer 1 moves further out of the equipment frame 2, lateral movement of the front surface 76 is prevented by action of the first and second guide rollers 26 and 41 acting against the lower guide track 15.

Upon reaching its fully withdrawn position, the catch notches 70 will be positioned for engagement by the engaging blades 62 of the latch 61 and upon release of the pushbutton 63 will so be engaged. In this position, the equipment drawer will be in a fully withdrawn and locked position, the latch 61 engaging the band 10 to prevent movement of the equipment drawer under force of the spring 50.

The equipment drawer 1 may be repositioned from a withdrawn to a retracted position by depressing the pushbutton 63. Such action will disengage the band engaging blades 62 from the band catch notches 70 and permit force from the spring 60 to act on the band 10 causing the band 10 to be withdrawn into the vertical column 55 and causing the band roller 5 to roll in a counterclockwise direction (refer to FIG. 3). Such action will cause the equipment drawer to self retract from its withdrawn position to its retracted position under force of the spring 50.

It will be appreciated that the force exerted by the spring 50 may be adjusted to permit self-retracting operation of the equipment drawer as described above or to merely take up slack in the band as the equipment drawer is pushed back into the equipment frame by the handle 75.

An adaptive layer 80 may be optionally provided on an outer layer 81 of the band 10. In this regard, the adaptive layer 80 may be a thin resilient material or rug like material where the supporting surface 3 includes a smooth covering 82 such as waxed tile. In cases where the covering 82 on the supporting surface 3 is of rough construction such as a shag rug type material, the adaptive layer 80 may be a plurality of stubby plastic projections (not shown) which include sloping walls to extend down through the rug pile to support surface 3 while not permitting the pile to catch them. The adaptive layer 80 may be provided in various other constructions to suit other types of the support surface covering 82.

Although the preferred embodiment of the present invention has been illustrated, and the form described in detail it will be readily apparent to those skilled in the art that various modifications may be made therein without departing from the spirit of the invention or from the scope of the appended claims.

What is claimed is:

1. A support for an equipment drawer, said support comprising:

an equipment frame mounted to a supporting surface;

a band roller attached to said drawer;

a band of flexible material positioned between said roller and said supporting surface, said band attached to said equipment frame via a first end and including a second end, said first end attached to said equipment frame to anchor and position said band relative to said equipment frame, said roller bearing against said band to support said drawer in rolling movement and said band adapted to provide a rolling surface for said band roller, to prevent said roller from directly contacting said supporting surface, and to engage said supporting surface while protecting said supporting surface from damage; and an elastic means connected between said drawer and said band second end, said elastic means taking up slack in said band when said drawer is rolled into a retracted position within said equipment frame.

2. A support as claimed in claim 1, wherein: said equipment drawer is of vertical construction, said band roller is attached at a lower edge of said drawer proximate a front edge thereof, said equipment frame further includes a lower guide track and a drawer slot adapted to receive said equipment drawer, and said equipment drawer further includes at least a lower guide roller attached to said drawer lower edge proximate a rear edge thereof, said lower guide roller engaging and rolling on said lower guide track, said band roller and said lower guide roller guiding and supporting said drawer in rolling movement.

3. A support as claimed in claim 1, wherein: said elastic means includes a spring attached to an anchor which is attached to a front column of said drawer.

4. A support as claimed in claim 1, wherein: said elastic means includes a spring attached to an anchor which is attached to a lower column of said drawer proximate said drawer lower edge.

5. A support as claimed in claim 1, wherein: said band is wound around a portion of said roller and said elastic means is adapted to exert a tensile force on said band thereby to cause said roller to rotate in a direction to cause said drawer to roll towards its retracted position.

6. A support as claimed in claim 5, wherein: said drawer includes band retention means engaging said band when said drawer is positioned in a withdrawn position out of said equipment frame to prevent said drawer from retracting.

7. A support as claimed in claim 6, wherein: said band retention means includes a latch attached to said drawer, said latch includes a biased sliding button including a pair of blades and said band includes a plurality of pairs of catches formed in opposite edges of said band, said blades engaging said catches to retain said band in said withdrawn position and to prevent movement of said band relative to said drawer.

8. A support as claimed in claim 2, wherein: said second roller includes a circumferential tread and a pair of sloping sidewalls and said lower guide track includes a groove with a flat bottom and and a pair of sloping sidewalls diverging from said flat bottom to a top of said guide track, said roller riding in said guide track to support and guide said drawer to maintain alignment of said drawer with said slot.

9. A support as claimed in claim 8, wherein: said support includes a third roller positioned between said second roller and said band roller, said third roller constructed in a manner similar to said second roller and said third roller riding in said lower guide track when said drawer is rolled into a retracted position to support said drawer and to lift said band roller and said band from contact with said supporting surface.

10. A support as claimed in claim 2, wherein: said drawer includes at least one upper guide roller attached to an upper surface of said drawer and rotating about a vertical axis, and said equipment frame includes an upper guide track of inverted U-shaped cross-section extending longitudinally in and at an upper end of said drawer slot, said upper guide roller riding within said upper guide track to guide said upper end of said drawer as said drawer is rolled between said retracted and said extended positions.

11. A support as claimed in claim 1, wherein: said band includes a layer of adaptive material attached to an outer surface thereof, said adaptive material layer engaging said supporting surface to support said band and to protect said supporting surface from damage.

12. A support as claimed in claim 11, wherein: said supporting surface includes a rug including a shag pile like surface positioned thereon and said adaptive material layer includes a plurality of stubby projections extending down through said shag pile to engage said supporting surface.

* * * * *